United States Patent [19]

Schave

[11] Patent Number: 4,692,028

[45] Date of Patent: Sep. 8, 1987

[54] SEALANT MELTER/APPLICATOR WITH AUTOMATIC LOAD SWITCHING SYSTEM

[75] Inventor: Floyd D. Schave, Mesa, Ariz.

[73] Assignee: Crafco, Inc., Phoenix, Ariz.

[21] Appl. No.: 897,870

[22] Filed: Aug. 19, 1986

[51] Int. Cl.[4] ..... B28C 1/22

[52] U.S. Cl. ..... 366/22; 366/13; 366/24; 366/51; 366/65; 366/149; 366/191; 366/601; 366/606

[58] Field of Search ..... 366/10, 13, 22, 24, 366/42, 51, 65, 64, 77, 131, 132, 137, 138, 144, 146, 149, 184, 191, 194, 279, 601, 606; 222/623, 610

[56] References Cited

U.S. PATENT DOCUMENTS

| | | | |
|---|---|---|---|
| 2,633,340 | 3/1953 | Zagray et al. | 366/51 |
| 2,900,138 | 8/1959 | Strate | 366/191 X |
| 3,286,995 | 11/1966 | Burklo | 366/51 |
| 3,606,264 | 9/1971 | Rosselot | 366/601 X |
| 4,046,357 | 9/1977 | Twitchell | 366/51 X |
| 4,159,877 | 7/1979 | Jacobsen et al. | 366/22 |
| 4,415,267 | 11/1983 | Hill | 366/65 X |
| 4,506,982 | 3/1985 | Smithers et al. | 366/22 X |

*Primary Examiner*—Timothy F. Simone

*Attorney, Agent, or Firm*—Cahill, Sutton & Thomas

[57] ABSTRACT

A sealant melter/applicator includes a sealant melting chamber, an internal combustion engine having a rotating power output shaft and an hydraulic pump which converts the rotary motion of the engine power output shaft into a flow of pressurized hydraulic fluid. The hydraulic pump is coupled to selectively energize a first hydraulic motor which rotates a sealant agitator positioned within the sealant melting chamber and a second hydraulic motor which drives a sealant pump for transferring sealant from the melting chamber through an applicator hose to a sealant discharge nozzle. A sealant flow control valve is coupled in series with the applicator hose to regulate the flow of sealant through the sealant discharge nozzle. A flow control valve position sensor is coupled to an hydraulic flow diverter valve. When the sealant flow control valve is placed in the "closed" position, the flow diverter valve directs the flow of pressurized hydraulic fluid to the first hydraulic motor is activate the sealant agitator. When the sealant flow control valve is displaced into the open position, the flow diverter valve directs the flow of pressurized hydraulic fluid to the second hydraulic motor to activate the sealant pump. By selectively activating the first and second hydraulic motors, the load on the engine is maintained substantially constant as sealant is intermittently discharged through the sealant flow control valve.

12 Claims, 3 Drawing Figures

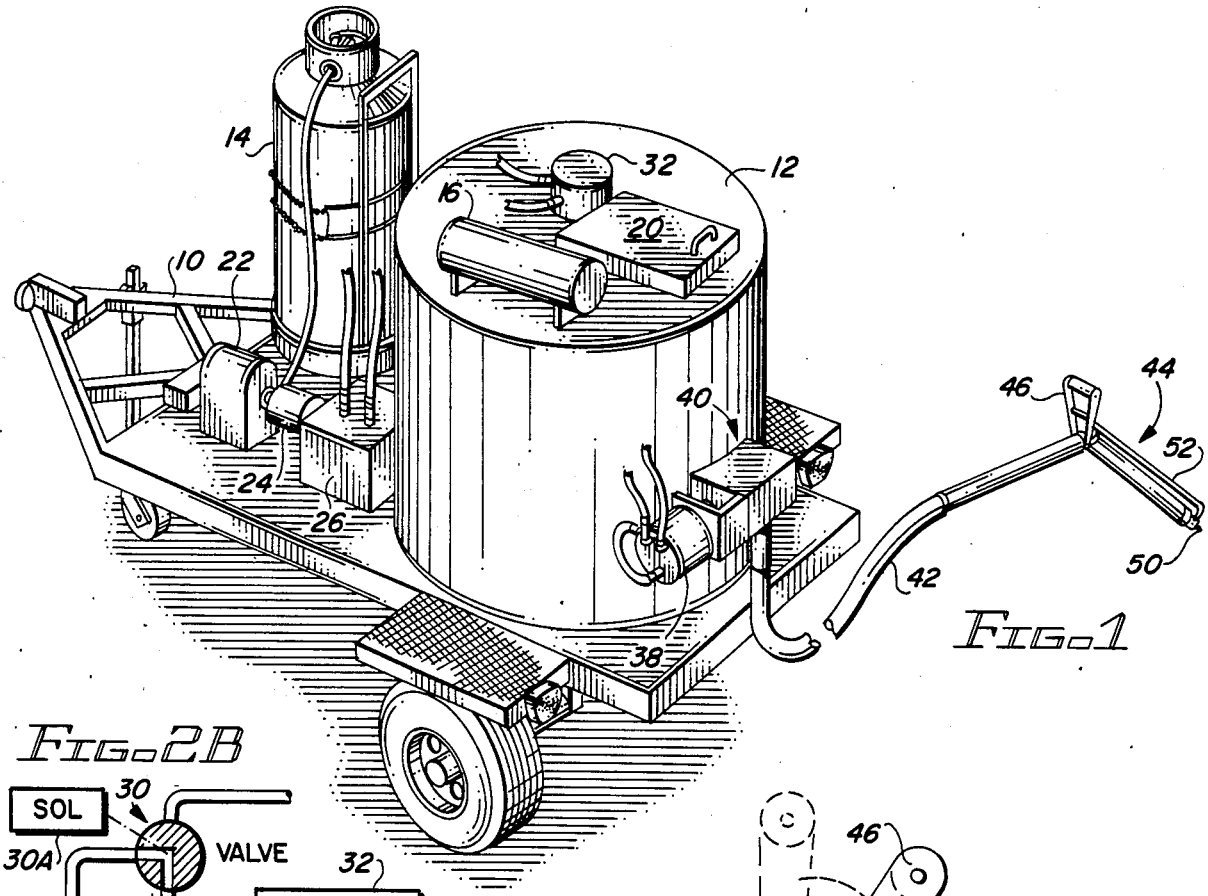
FIG. 1
FIG. 2B
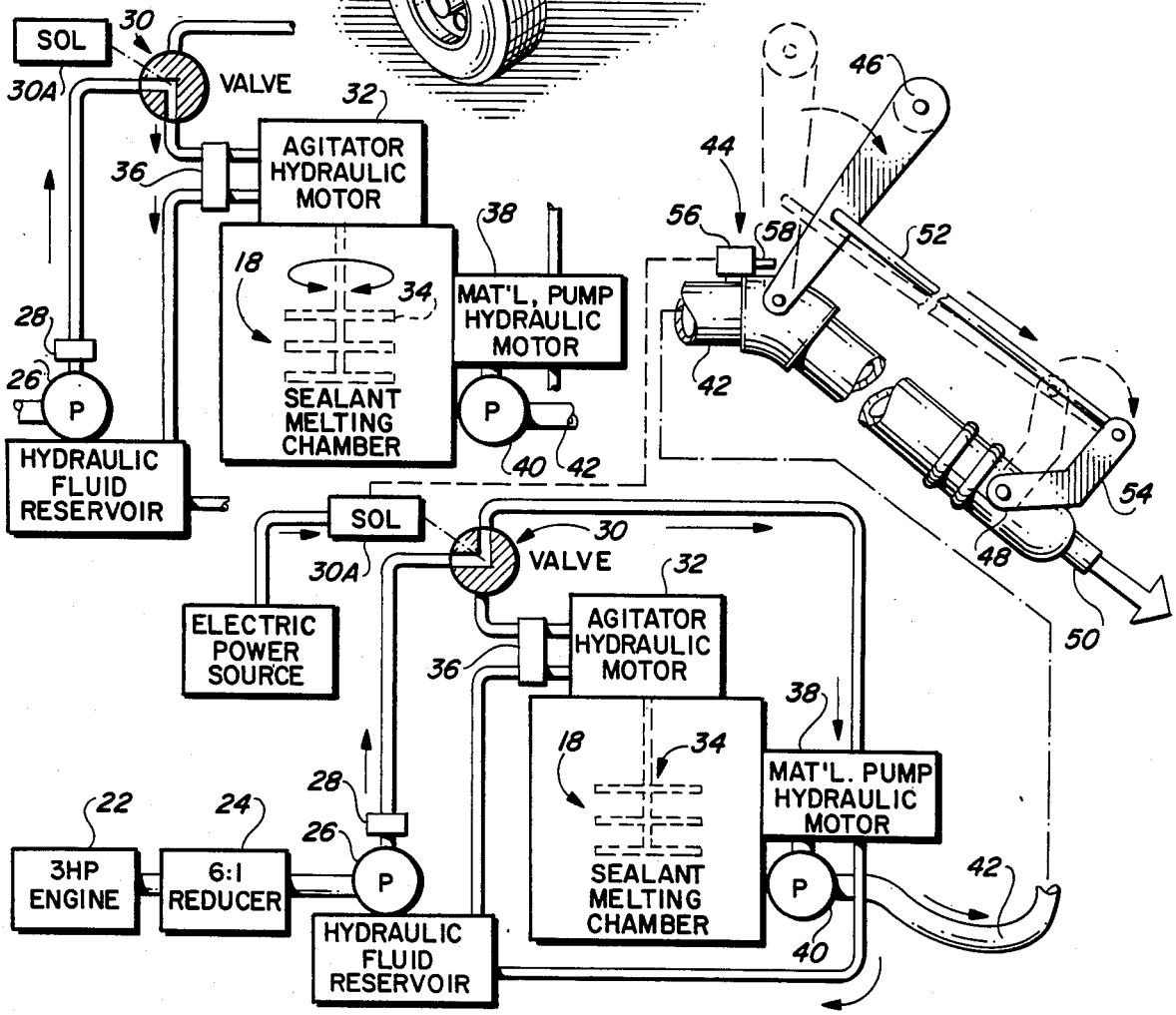
FIG. 2A

SEALANT MELTER/APPLICATOR WITH AUTOMATIC LOAD SWITCHING SYSTEM

BACKGROUND OF THE INVENTION

1. FIELD OF THE INVENTION

This invention relates to sealant melter/applicator equipment, and more particularly, to sealant melter/applicator equipment energized by an internal combustion engine and having an automatic load switching system for selectively activating either a sealant agitator or a sealant pump.

2. DESCRIPTION OF THE PRIOR ART

A prior art trailer-mounted sealant melter/applicator includes a low cost, low power internal combustion engine which energizes a hydraulic system for continuously driving a reversible, vertically oriented sealant agitator assembly. During the equipment start up phase, the substantially solid, ambient temperature sealant is transformed by heat into high temperature molten sealant. The molten sealant is periodically drained by gravity from a manually actuated valve positioned at the lower rear surface of a vertically oriented sealant tank. A portable sealant dispensing container is periodically refilled from the manually actuated valve on the sealant melter/applicator. This prior art sealant melter/applicator is the predecessor of the present invention.

More sophisticated sealant melter/applicator equipment of the type disclosed in U.S. Pat. No. 4,159,877 utilizes a substantially larger, higher cost two cylinder air cooled engine to energize a hydraulic system having first and second hydraulic pumps coupled in separate hydraulic circuits to independently drive a continuous duty reversible sealant mixing auger and an intermittent duty reversible sealant pump. During sealant application procedures, the sealant pump is continuously activated to dispense molten sealant under pressure through a hose having an end-mounted applicator wand. The discharge of sealant from the applicator wand is controlled by a manual, operator-controlled on/off valve located in the wand. The sealant pump continues to rotate to provide pressurized sealant to the manual on/-off valve regardless of the position of that valve.

In this comparatively expensive prior art system, the power output of the internal combustion engine is adequate to enable the sealant mixing auger and the sealant pump to be simultaneously activated without causing engine overloading or stalling.

A substantial price disparity exists between the relatively uncomplicated gravity flow discharge sealant melter/applicator described above and the substantially higher cost, higher performance dual pump hydraulic system sealant melter/applicator disclosed in U.S. Pat. No. 4,159,877.

SUMMARY OF THE INVENTION

It is therefore a primary object of the present invention to provide a sealant melter/applicator capable of utilizing a low horsepower, low cost internal combustion engine to energize a single pump hydraulic system coupled to drive both a sealant agitator and a sealant pump by selectively switching the load on the hydraulic pump between a sealant agitator and a sealant pump to maintain the load on the internal combustion engine substantially constant.

Another object of the present invention is to provide a sealant melter/applicator having an hydraulic system which normally energizes a sealant agitator, but which is periodically automatically reconfigured to direct the entire output of a single hydraulic pump to a sealant pump when transferring sealant from a sealant melting chamber through a sealant applicator hose to a sealant discharge nozzle.

Yet another object of the present invention is to provide a sealant melter/applicator having an hydraulic system including an electrically actuated automatic load switching system responsive to the posititon of a remotely located sealant flow control valve.

Still another object of the present invention is to provide a sealant melter/applicator which uses a single low horsepower, low cost internal combustion engine to drive both a sealant agitator and a sealant pump where the power requirements of either the sealant agitator or the sealant pump substantially equal the steady state engine power output.

Briefly stated, and in accord with one embodiment of the invention, a sealant melter/applicator includes a sealant melting chamber, an internal combustion engine having a rotating power output shaft and an hydraulic pump for converting the rotary motion of the engine power output shaft into a flow of pressurized hydraulic fluid. A first hydraulic motor includes an output shaft which drives a sealant agitator positioned within the sealant melting chamber. A second hydraulic motor drives a sealant pump to transfer sealant from the sealant melting chamber through an applicator hose to a sealant discharge nozzle. A sealant flow control valve displaceable between open and closed positions is coupled in series with the applicator hose to regulate the flow of sealant through the sealant discharge nozzle. Position sensing means senses the position of the sealant flow control valve. Flow diverter means is coupled to the position sensing means and to the hydraulic pump to direct the flow of pressurized hydraulic fluid from the hydraulic pump to the first hydraulic motor when the sealant flow control valve is in the closed position and to direct the flow of pressurized hydraulic flow from the hydraulic pump to the second hydraulic motor when the sealant flow control valve is in the open position. The automatic load switching system of the present invention maintains the load on the engine substantially constant as sealant is intermittently discharged through the sealant flow control valve.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG.1 is a perspective view of a sealant melter/applicator of the present invention.

FIG. 2A is a schematic diagram depiction of a sealant melter/applicator of the present invention, depicting the sealant flow control valve displaced into the "open" position which automatically energizes the sealant pump hydraulic motor and deenergizes the sealant agitator hydraulic motor.

FIG. 2B is a schematic diagram depiction of a sealant melter/applicator of the present invention, depicting the sealant flow control valve displaced into the "closed" position which automatically energizes the sealant agitator hydraulic motor and de-energizes the sealant pump hydraulic motor.

DESCRIPTION OF THE PREFERRED EMBODIMENT

In order to better illustrate the advantages of the invention and its contributions to the art, a preferred hardware embodiment of the invention will now be described in detail.

Although the term sealant is used uniformly to describe the material which is melted and pumped by the sealant melter/applicator of the present invention, any equivalent material which maintains a highly viscous, substantially solid state at ambient temperature and a molten, low viscosity state at temperatures on the order of 350° F. also falls within the scope of the term "sealant."

Referring now to FIGS. 1 and 2, the sealant melter/applicator of the present invention includes a number of elements mounted on a trailer 10 to permit the sealant melter/applicator to be readily transported over a highway. In another embodiment of the present invention, the sealant melter/applicator may be skid mounted to permit the unit to be positioned on the bed of a truck.

A vertically oriented, cylindrical sealant melting tank 12 is fabricated in a conventional double boiler configuration of the general type depicted in U.S. Pat. No. 4,159,877. Such a melting tank configuration includes an outer shell, an inner shell, a hot oil heating tank and a layer of insulating material which is disposed between the outer and inner tank shells. A propane tank 14 is coupled to provide flow of gaseous fuel which is directed to a thermostatically controlled gas burner assembly positioned in the base of sealant melting tank 12. The normal thermal expansion of the heating oil is accommodated in oil expansion chamber 16 which is positioned on the upper horizontally oriented surface of sealant melting tank 12. Blocks of cold, semi-solid sealant are loaded into the internal vertically oriented, cylindrical sealant melting chamber 18 through door 20.

An air-cooled, three horsepower Briggs and Stratton internal combustion engine 22 is coupled through a six-to-one gear reduction unit 24 to drive an hydraulic pump 26. In the preferred embodiment of the present invention, a commercially available open loop hydraulic pump/reservoir assembly having an output of 1.26 gallons per minute at six hundred RPM is utilized to energize the hydraulic system of the present invention. A two thousand P.S.I. pressure relief valve 28 limits the maximum hydraulic system pressure in accordance with conventional hydraulic design techniques.

The flow of pressurized hydraulic fluid from hydraulic pump 26 is directed through flow diverter means in the form of an electrically controlled, solenoid actuated diverter valve 30. In the non-energized state, diverter valve 30 directs the flow of pressurized hydraulic fluid from pump 24 through a first hydraulic motor 32 which is coupled to rotate the vertically disposed shaft of a sealant agitator 34. A flow reversing valve 36 permits the sealant melter/applicator operator to reverse the direction of flow of hydraulic fluid to hydraulic motor 32 to control the direction of rotation of sealant agitator 34.

A second hydraulic motor 38 is coupled to rotate sealant pump 40 which transfers molten sealant from the internal sealant melting chamber 18 through a flexible sealant applicator hose 42. A rigid sealant dispensing wand 44 is coupled to the end of sealant applicator hose 42 and includes an operator hand grip 46, a sealant flow control valve 48 and a sealant discharge nozzle 50.

A rigid linkage element 52 is rotatably coupled at a first end to hand grip 46 and at a second end to lever actuator arm 54 for sealant flow control valve 48. Movement of operator hand grip 46 from the vertical position depicted in dotted lines in FIG. 2A into the inclined position depicted in solid lines displaces the sealant flow control valve from a "closed" position into an "open" position where sealant is discharged through discharge nozzle 50.

In the preferred embodiment of the invention, sealant flow control valve position sensing means takes the form of an electric microswitch 56 which is rigidly coupled to the upper end of sealant dispensing wand 44. Microswitch 56 includes a spring biased shaft 58. Shaft 58 of microswitch 56 is displaced inward into a first position when operator hand grip 46 is moved into the "closed" position and outward into a second position when operator hand grip 46 is displaced into the "open" position.

When in the first position, microswitch 56 de-energizes diverter valve 30 as depicted in FIG. 2B and directs hydraulic fluid through first hydraulic motor 32 to drive sealant agitator 34. When displaced into the second position, microswitch 56 causes electrical current to flow through solenoid 30A which displaces diverter valve 30 into the configuration depicted in FIG. 2A. In this energized state, diverter valve 30 directs the flow of pressurized hydraulic fluid away from first hydraulic motor 32 and toward second hydraulic motor 38 which rotates sealant pump 40 and transfers molten sealant under pressure through sealant applicator hose 42, sealant dispensing wand 44 and sealant discharge nozzle 50. Solenoid 30A may be designed to be energized by either AC or DC electrical current obtained from a trailer-mounted storage battery or electrical generating system, from a vehicle electrical system, or from other available sources of electrical power.

The chart appearing below illustrates the relative position of sealant flow control valve 48 with respect to the flow of hydraulic fluid through agitator motor 32 and material pump motor 40.

| | Agitator Motor 32 | Material Pump Motor 40 |
|---|---|---|
| Sealant Flow Control Valve 48 Closed | ON | OFF |
| Sealant Flow Control Valve 48 Open | OFF | ON |

When the sealant melter/applicator of the present invention is initially started up, the gas burner assembly heats the oil surrounding sealant melting chamber 18 and slowly elevates the temperature of the cool, semi-solid sealant. During these initial heating operations, the entire output of internal combustion engine 22 is used to energize hydraulic pump 26 and to rotate first hydraulic motor 32 and sealant agitator 34. After the sealant has been brought up to operating temperature, an operator periodically actuates hand grip 46 and sealant flow control valve 48 to inject molten sealant into cracks in a road or onto an equivalent application surface. During such intermittent sealant application operations, diverter valve 30 completely deactivates first hydraulic motor 32 and sealant agitator 34 and directs the entire power output of engine 22 to drive second hydraulic motor 38 which energizes sealant pump 40. The automatic load switching system of the present invention thus permits a low horsepower, light weight and low cost internal combustion engine to intermittently operate both a sealant agitator as well as a sealant pump. Overload and stalling of engine 22 is prevented by proper sizing of hydraulic motors 32 and 38, by proper design of sealant agitator 32 and by proper sizing of sealant pump 40. In the preferred embodiment of the present invention, first hydraulic motor 32 includes the following specifications: displacement 9.4 cubic inches per revolution; maximum speed - 29 RPM. In the preferred embodiment of the present invention, second hydraulic motor 38 includes the following specifications: displacement 2.04 cubic inches per revolution; maximum speed - 132 RPM. A Viking H-32B pump having a maximum material flow of 1.3 gallons per minute is utilized in combination with hydraulic motor 38.

It will be apparent to those skilled in the art that the disclosed sealant melter/applicator may be modified in numerous ways and may assume many embodiments other than the preferred form specifically set out and described above. For example, diverter valve 30 may be selected to transfer a proportional amount of hydraulic fluid away from first hydraulic motor 32 and toward second hydraulic motor 38 as sealant flow control valve 48 is gradually displaced between a fully closed position, through an intermediate position, to a fully open position. The transfer characteristics of such a diverter valve 30 could be designed to derive a maximum horsepower or torque force transfer from motor 22 into hydraulic pump 26 in a manner well known to one of ordinary skill in the appropriate field of technology. In place of two state microswitch 56, a position sensing device having a continuously variable output could be utilized to sense the exact position of valve 48 as it is moved between the "open," "intermediate," and "closed" positions. Accordingly, it is intended by the appended claims to cover all such modification of the invention which fall within the true spirit and scope of the invention.

I claim:

1. A load switching system for a sealant melter/applicator comprising:

a. a sealant melting chamber;

b. an internal combustion engine for rotating a power output shaft;

c. an hydraulic pump for converting the rotary motion of said power output shaft into a flow of pressurized hydraulic fluid;

d. a first hydraulic motor having an output shaft for driving a sealant agitator positioned within said sealant melting chamber;

e. a second hydraulic motor for driving a sealant pump to transfer sealant from said sealant melting chamber through an applicator hose to a sealant discharge nozzle;

f. a sealant flow control valve coupled in series with said hose for regulating the flow of sealant through said sealant discharge nozzle, said valve including open and closed positions;

g. means for sensing the position of said sealant flow control valve; and h. flow diverter means coupled to said position sensing means and to said hydraulic pump for directing the flow of pressurized hydraulic fluid from said hydraulic pump to said first hydraulic motor when said sealant flow control valve is in the closed position and for directing the flow of pressurized hydraulic fluid from said hydraulic pump to said second hydraulic motor when said sealant flow control valve is in the open position;

whereby the load on said engine is maintained substantially constant as sealant is intermittently discharged through said sealant flow control valve.

2. The load switching system of claim 1 wherein said sealant flow control valve further includes an intermediate position between the open and closed positions and wherein said flow diverter means divides the flow from said hydraulic pump to said first and second hydraulic motors in proportion to the load on each motor.

3. The load switching system of claim 1 wherein said flow diverter means directs the output of said hydraulic pump to said second hydraulic motor when said sealant flow control is moved out of the closed position

4. The load switching system of claim 1 wherein said flow diverter means includes an electrically actuated flow diverter valve.

5. The load switching system of claim 4 wherein said position sensing means includes an electric switch having a spring biased shaft positioned to produce a first output state when said sealant flow control valve is maintained in the closed position and to produce a second ouput state when said sealant flow control valve is displaced out of the closed position.

6. The load switching system of claim 5 wherein said electric switch includes a microswitch.

7. The load switching system of claim 1 wherein said sealant flow control valve is coupled to the discharge end of a sealant dispensing wand having valve actuator means, inlet and outlet ends and an operator hand grip positioned at the inlet end of said wand.

8. The load switching system of claim 1 wherein said position sensing means includes electric position sensing means coupled to sense the position of said valve actuator means for generating an electrical valve position signal representative of the position of said sealant flow control valve.

9. The load switching system of claim 8 wherein said electric position sensing means includes an electric switch having a spring biased shaft positioned to produce a first output state when said sealant flow control valve is maintained in the closed position and to produce a second output state when said sealant flow control valve is displaced out of the closed position.

10. The load switching system of claim 9 wherein said sealant melter/applicator further includes a source of electrical power for energizing said flow diverter valve.

11. The load switching system of claim 10 wherein said source of electric power includes an electrical generating system powered by an internal combustion engine.

12. The load switching system of claim 1 wherein said sealant melter/applicator is mounted on a trailer for highway mobility.

* * * * *